US008429824B2

(12) United States Patent
Brown et al.

(10) Patent No.: US 8,429,824 B2
(45) Date of Patent: Apr. 30, 2013

(54) INSULATED PANELS AND SYSTEMS AND METHODS FOR FORMING SEALED INSULATED PANELS

(75) Inventors: Mark Brown, Middletown, OH (US); Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 412 days.

(21) Appl. No.: 12/832,337

(22) Filed: Jul. 8, 2010

(65) Prior Publication Data

US 2011/0162307 A1 Jul. 7, 2011

Related U.S. Application Data

(60) Provisional application No. 61/223,891, filed on Jul. 8, 2009.

(51) Int. Cl.
*B21D 47/00* (2006.01)

(52) U.S. Cl.
USPC ..... 29/897.32; 29/897.34; 52/309.17

(58) Field of Classification Search ..... 29/897, 29/897.31, 897.312, 897.32, 897.34; 52/309.1, 52/309.12, 309.17, 742.14, 794.1
See application file for complete search history.

(56) References Cited

U.S. PATENT DOCUMENTS

| | | | | |
|---|---|---|---|---|
| 4,270,321 | A | 6/1981 | Fisher | |
| 4,349,492 | A | 9/1982 | Shoham | |
| 4,669,240 | A | 6/1987 | Amormino | |
| 5,119,606 | A | 6/1992 | Graham | |
| 5,758,463 | A * | 6/1998 | Mancini, Jr. | 52/309.12 |
| 6,099,768 | A * | 8/2000 | Strickland et al. | 264/46.4 |
| 6,212,831 | B1 | 4/2001 | White | |
| 6,263,638 | B1 | 7/2001 | Long, Sr. | |
| 6,308,491 | B1 | 10/2001 | Porter | |
| 6,363,674 | B1 | 4/2002 | Carver | |
| 2006/0265985 | A1 | 11/2006 | Nichols | |

* cited by examiner

*Primary Examiner* — David Bryant
*Assistant Examiner* — Ryan J Walters
(74) *Attorney, Agent, or Firm* — Dinsmore & Shohl LLP

(57) ABSTRACT

Insulated panels and methods of forming insulated panels are provided. According to the method, mold bulkhead and a sealing strip including a first anchor extension, a second anchor extension, and a panel cap are provided. The method also includes removably attaching the exterior face of the sealing strip to the interior mold surface on at least one of the plurality of mold sides, wherein the first anchor extension and the second anchor extension project into the interior mold volume, and wherein the sealing strip defines a sealed insulation zone. A curable building material is introduced into the interior mold volume to form a first slab. The first slab at least partially surrounds the first anchor extension. The method also includes inserting an insulation material layer into the interior mold volume, wherein the insulation material layer is at least partially within the sealed insulation zone. A curable building material is introduced into the interior mold volume adjacent to the insulation material layer to form a second slab. The second slab at least partially surrounds the second anchor extension. The method also includes the step of allowing the curable building material to cure to provide a cured insulated panel, wherein the panel cap defines at least a portion of at least one of the plurality of intermediate faces.

15 Claims, 3 Drawing Sheets

INSULATED PANELS AND SYSTEMS AND METHODS FOR FORMING SEALED INSULATED PANELS

CROSS-REFERENCE TO RELATED APPLICATIONS

This application claims the benefit of U.S. Provisional Application Ser. No. 61/223,891, filed Jul. 8, 2009.

BACKGROUND

Insulated concrete panels generally comprise two concrete slabs and an insulation layer provided there-between. They are often referred to as insulated panels or sandwich panels, or as structural insulated panels. Insulated panels recently have gained communal acceptance and popularity for both commercial and residential construction applications. Not only are the insulated panels resistant to termite infestation and structurally strong, but they are also energy efficient and environmentally-friendly.

However, the structural integrity of an insulated panel may be compromised if moisture penetrates the insulation layer and/or between the insulation layer and the concrete slabs. Insulated panels are often exposed to moisture about their ends, allowing seepage into and about the insulation panel, which promotes mold growth and rot, and compromises structural integrity. In order to solve this problem, some insulated panels have their ends coated with shotcrete or cement plaster. However, coating the insulated panels requires an additional manufacturing step, which increases both their production time and cost. In addition, the applied coating material may crack, flake, chip, and/or otherwise degrade, particularly during structural construction, and, thereby, the panel becomes susceptible to moisture seepage. As such, there exists a need for a method to form insulated panels that are sealed from moisture and sufficiently durable to maintain their structural integrity.

SUMMARY

The present disclosure relates generally to methods for forming insulated panels, including sealed insulated panels. Additional embodiments of the present disclosure relate generally to sealed insulated concrete panels including a first slab, a second slab, an insulation material layer, and a sealing strip.

Although the methods of the present disclosure are not limited to particular insulated panels, for the purposes of illustration, the method steps are illustrated herein with reference to specific insulated panel configurations.

It is contemplated that the methods of the present disclosure will also enjoy utility in forming other insulated panels, including those that are structurally similar to or distinct from the insulated panels illustrated herein.

In accordance with one embodiment of the present disclosure, a method of forming an insulated panel comprising a first major face, a second major faces, and a plurality of intermediate faces is provided. The method includes providing a mold bulkhead including an interior mold surface defining an interior mold volume, wherein the interior mold surface comprises a plurality of mold sides and providing at least one sealing strip including a first anchor extension, a second anchor extension, and a panel cap, wherein the panel cap comprises an interior face and an exterior face. The method also includes removably attaching the exterior face of the sealing strip to the interior mold surface on at least one of the plurality of mold sides, wherein the first anchor extension and the second anchor extension project into the interior mold volume, and wherein the sealing strip defines a sealed insulation zone and introducing a curable building material into the interior mold volume to form a first slab, wherein the first slab defines the first major face, and wherein the first slab at least partially surrounds the first anchor extension. The method also includes inserting an insulation material layer into the interior mold volume, wherein the insulation material layer is at least partially within the sealed insulation zone, and introducing a curable building material into the interior mold volume adjacent to the insulation material layer to form a second slab, wherein the second slab defines the second major face, wherein the second slab at least partially surrounds the second anchor extension. The method also includes the step of allowing the curable building material to cure to provide a cured insulated panel, wherein the panel cap defines at least a portion of at least one of the plurality of intermediate faces.

In accordance with another embodiment of the present disclosure, a method of forming an insulated panel comprising a first major face, a second major face, and a plurality of intermediate faces is provided. The method includes providing a mold bulkhead comprising an interior mold surface defining an interior mold volume, wherein the interior mold surface comprises a plurality of mold sides, providing at least one sealing strip including a first anchor extension, a second anchor extension, and a panel cap, wherein the panel cap comprises an interior face and an exterior face. The method also includes removably attaching the exterior face of the sealing strip to the interior mold surface on at least one of the plurality of mold sides, wherein the first anchor extension and the second anchor extension project into the interior mold volume, and wherein the sealing strip defines a sealed insulation zone, and wherein the first anchor extension and second anchor extension including a plurality of anchoring apertures. The first anchor extension and the second anchor extension may respectively extend at an angle ranging from approximately 100° to approximately 135° relative to the interior face. The method includes introducing a curable building material into the interior mold volume to form a first slab, wherein the first slab defines the first major face, and wherein the first slab at least partially surrounds the first anchor extension, and inserting an insulation material layer into the interior mold volume, wherein the insulation material layer is at least partially within the sealed insulation zone. Furthermore, the method includes introducing a curable building material into the interior mold volume adjacent to the insulation material layer to form a second slab, wherein the second slab defines the second major face, wherein the second slab at least partially surrounds the second anchor extension, and allowing the curable building material to cure to provide a cured insulated panel, wherein the panel cap defines at least a portion of at least one of the plurality of intermediate faces.

In accordance with yet another embodiment of the present disclosure, an insulated panel comprising a first major face, a second major faces, a plurality of intermediate faces, a first slab, a second slab, an insulation material layer, and at least one sealing strip is provided. The first slab and the second slab each comprise a curable building material. The insulation material layer is provided between the first slab and the second slab. The first slab defines the first major face of the insulated panel. The second slab defines the second major face of the insulated panel. The at least one sealing strip includes a first anchor extension, a second anchor extension, and a panel cap. The panel cap includes an interior face and an exterior face. The first slab, the second slab, and the exterior face cooperate to define the plurality of intermediate faces.

The first slab at least partially surrounds the first anchor extension, such that the first anchor extension is embedded in the first slab. The second slab at least partially surrounds the second anchor extension, such that the second anchor extension is embedded in the second slab. The sealing strip defines a sealed insulation zone, and the insulation material layer is provided at least partially within the sealed insulation zone.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
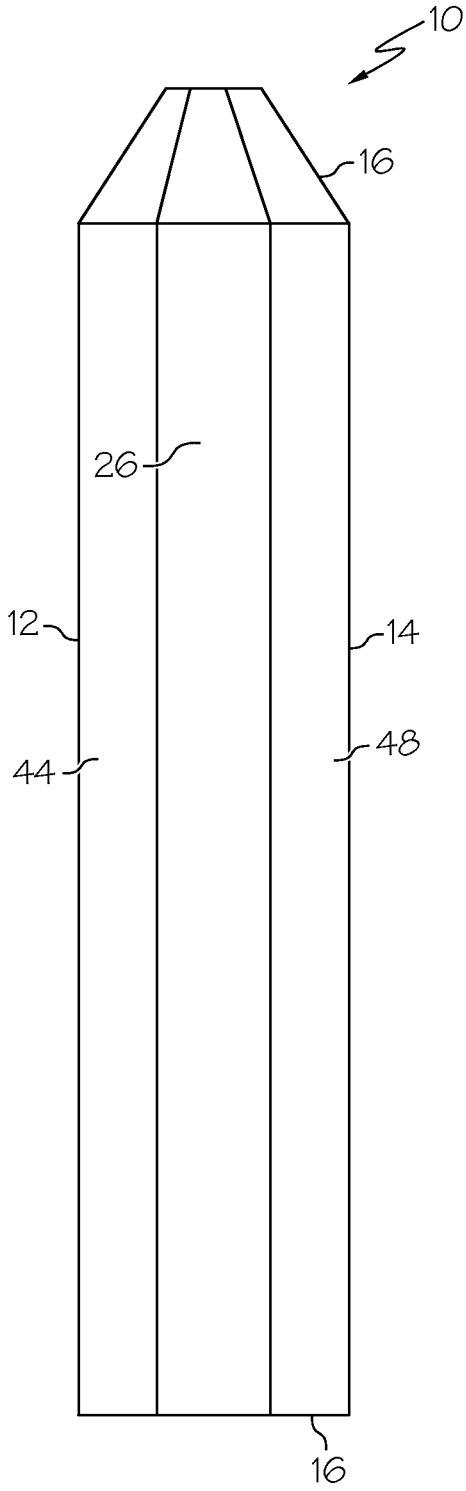
FIG. 1 is an perspective view of an insulated panel in accordance with another embodiment.
Figure 2:
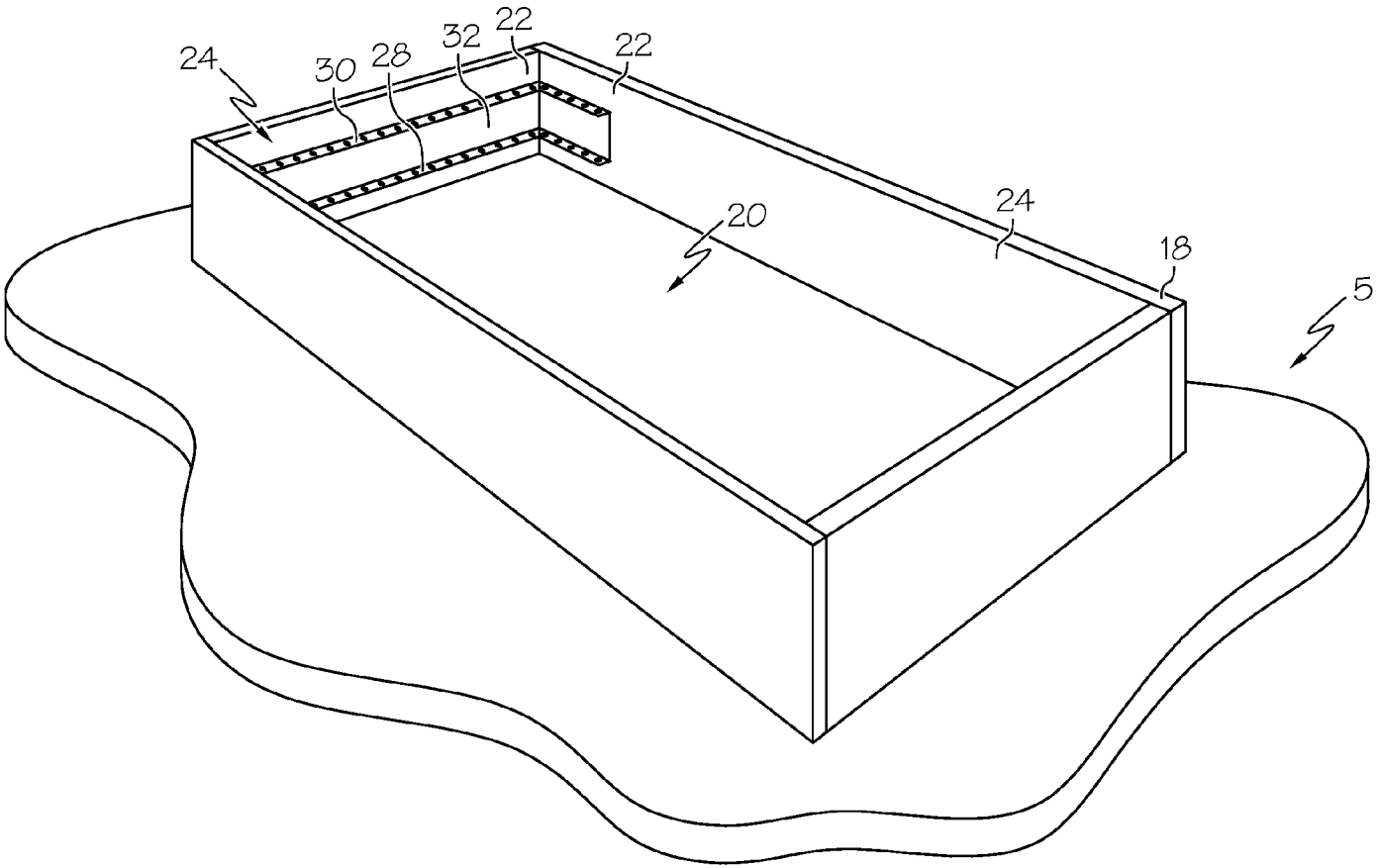
FIG. 2 is a perspective view of a mold bulkhead and a sealing strip in accordance with one embodiment.

Referring to FIG. 1, in one embodiment, a method of forming an insulated panel 10 is provided. The insulated panel is formed on a mold slab 5. The method comprises forming an insulated panel 10 comprising a first major face 12 and a second major face 14 and a plurality of intermediate faces 16. Referring to FIG. 2, the method comprises providing a mold bulkhead 18 that defines an interior mold volume 20 and an interior mold surface 22, wherein the interior mold surface 22 comprises a plurality of mold sides 24, and providing at least one sealing strip 26 comprising a first anchor extension 28, a second anchor extension 30, and a panel cap 32. The panel cap 32 comprises an interior face 34 and an exterior face 36 (See FIG. 3A). Referring again to FIG. 2, the method also comprises removably attaching the sealing strip 26 to the interior mold surface 22 on the plurality of mold sides 24 to project the first anchor extension 28 and the second anchor extension 30 into the interior mold volume 20, wherein the sealing strip 26 defines a sealed insulation zone 42, and introducing a curable building material into the interior mold volume 20 to form a first slab 44 defining the first major face 12, wherein the first slab 44 at least partially surrounds the first anchor extension 28. The method also comprises inserting an insulation material layer 46 into the interior mold volume 20 within the sealed insulation zone 42 adjacent to the first slab 44 and introducing a curable building material into the interior mold volume adjacent to the insulation material layer to form a second slab 48 defining the second major face 14, wherein the second slab 48 at least partially surrounds the second anchor extension 30, and allowing the curable building material to cure to provide a cured insulated panel 10, wherein the panel cap 32 defines at least a portion of at least one of the plurality of intermediate faces 16.

Referring to FIG. 1, the insulated panel 10 comprises a first major face 12, a second major face 14, and a plurality of intermediate faces 16. The first major face 12 and second major face 14 comprises the exposed faces of the insulated panel 10 having the largest surface area. Alternatively, the first major face 12 and second major face 14 may comprise the surfaces of the panel that did not previously contact the mold bulkhead 18. The intermediate faces 16 may comprise the sides of the insulated panel 10 that were in contact with the mold bulkhead 18 during the curing process. Furthermore, the intermediate faces 16 comprise a portion of a first slab 44, a portion of a second slab 48, and an exterior face 36 of a sealing strip 26 as will be described below.

Referring to FIG. 2, in one embodiment, the method comprises providing a mold bulkhead 18 that defines an interior mold volume 20 and an interior mold surface 22. The mold bulkhead 18 may be placed on a mold slab 5 which defines the bottom of the interior mold volume 20. The interior mold surface 22 comprises a plurality of mold sides 24. The mold bulkhead 18 defines the shape of the insulated panel (See FIG. 1) that may be ultimately formed. The mold bulkhead 18 may define an interior mold surface 22 having a rectangular shape, circular shape, and other polygonal shapes suited to the desired application of the insulated panel 10. The mold bulkhead 18 may comprise materials suitable to shape and retain a curable building material, such as plastic, wood, or metal, as will be appreciated by one of ordinary skill in the art.

The interior mold volume 20 comprises the volume defined by the mold bulkhead 18. The lateral edges of the interior mold volume 20 are partially defined by the interior mold surface 22 which comprises a plurality of mold sides 24. The open faces of the mold bulkhead 18 define the remainder of the interior mold volume 20, and ultimately define the first major face 12 and second major face 14. The number of mold sides 24 depends on the shape of the mold bulkhead 18 discussed above. For example, if the mold bulkhead 18 is rectangular, there may be four mold sides 24. It is also contemplated that the mold sides 24 may be textured to provide an easier release of the insulated panel, or to provide an aesthetic finish to the insulated panel 10, such as simulated wood grain, brick, or block type finish.

Figure 3A:
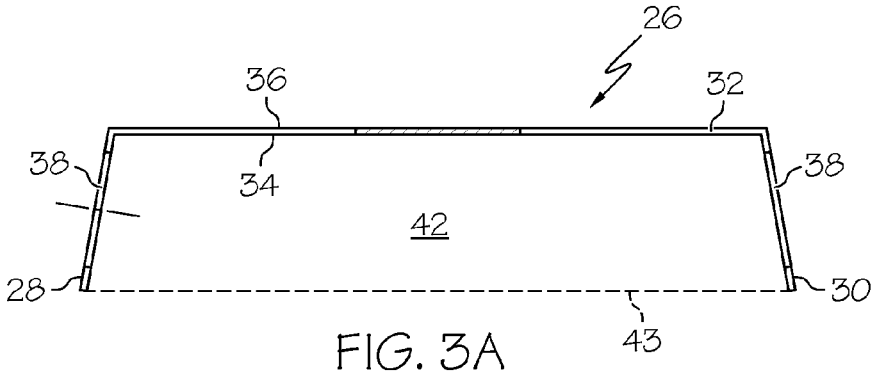
FIG. 3A is a cross sectional view of a sealing strip in accordance with one embodiment.

Referring to FIG. 3A, the method comprises providing at least one sealing strip 26 comprising a first anchor extension 28, second anchor extension 30, and a panel cap 32. The panel cap 32 defines an interior face 34 and an exterior face 36. The sealing strip 26 is generally configured as a length of longitudinally extending material. The sealing strip 26 becomes integrated into the insulated panel 10 after curing the curable building material. The sealing strip 26 interacts with a first slab 44 and a second slab 48 to prevent moisture from entering the sealed insulation zone 42 (See FIG. 4).

The sealing strip 26 also may be configured in a T-shape, L-shape, or other configuration to facilitate its application to corners or other areas of a mold bulkhead 18 and its integration into variously shaped insulated panels 10 as will be appreciated by one of ordinary skill.

Figure 4:
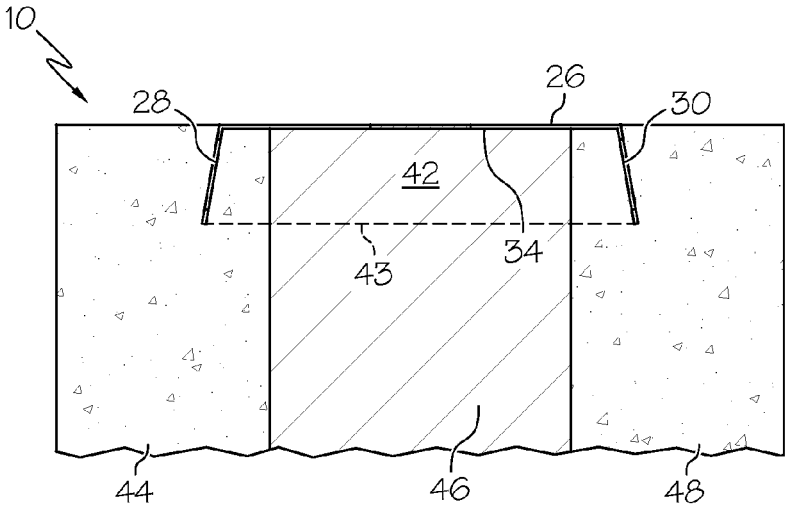
FIG. 4 is a cross-sectional view of an insulated panel in accordance with yet another embodiment.

The panel cap 32 is configured such that the exterior face 36 defines a portion of an exterior surface of an insulated panel 10 on at least one of the plurality of intermediate faces 16 into which the sealing strip 26 is integrated, as shown in FIG. 4. Thereby, with release from the insulated panel 10 of the mold bulkhead 18, the exterior face 36 of the panel cap 32 is exposed to the environment surrounding the insulated panel 10. In addition, as shown in FIG. 3A, the exterior face 36 may be substantially planar so as to facilitate its application to the interior mold surface 22 of the mold bulkhead 18. The panel cap 32 may comprise a rectangular shape. The dimensions of the panel cap 32 are selected to be wider than the insulation material layer 46 used to form the insulated panel 10. The width of the panel cap 32 may be larger than the insulation material layer 46 to define a sealed insulation zone 42.

Referring to FIG. 4, the anchor extensions 28, 30 extend away from the exterior face 36 of the panel cap 32. The anchor extensions may be provided down the entire length of the sealing strip, or may have a length less than the length of the sealing strip 26. In one embodiment, the anchor extensions 28, 30 have a width such that the tip of the first anchor extension 28 and second anchor extension 30 are at least partially surrounded by a curable building material. The distal edge of the first anchor extension is provided at a distance greater than 3 cm from the first major face, and wherein a distal edge of the second anchor extension is provided at a distance greater than 3 cm from the second major face. Generally, the anchor extensions 28, 30 should not extend into the first slab 44 and second slab 48 for a dimension that weakens the structural integrity of the curable building material. If the anchor extensions extend too close to the first major face or second major face, the curable building material may chip off.

The first anchor extension may extend less than 3 cm or approximately 3 cm into the first slab, and the second anchor extension is less than 3 cm, or approximately 3 cm into the second slab. Alternatively, the first anchor extension 28 and the second anchor extension 30 have a width less than approximately 5 cm from the panel cap 32, or less than 3 cm, or less than 2 cm. The width of the first and second anchor extensions may be adjusted and selected to suit the thickness of the insulation material layer, first slab, and second slab.

The angle at which the anchor extensions 28, 30 extend from the panel cap 32 may be defined by the relationship between the anchor extensions 28, 30 and the interior face 34. The first anchor extension 28 and the second anchor extension 30 respectively extend at an angle ranging from approximately 100° to approximately 135° relative to the interior face 34. For example, as shown in FIG. 3, the anchor extensions 28, 30 respectively extend at an angle of approximately 100°. However, it is also contemplated that the angle is not limited to 100°, but rather, may be any angle more than 0° and less than 180° provided that the first anchor extension and the second anchor extension each respectively extend along an anchoring vector selected to ensure that respective distal edges of the first and second anchor extensions are displaced from the major and intermediate faces of the insulated panel by at least approximately 3 cm. Generally, however, the angle is between approximately 45° and approximately 135°, or between approximately 80° and approximately 120°. For example, the first anchor extension 28 may extend at an angle of approximately 70° relative to the interior face 34, while the second extension 30 may extend at an angle of approximately 110° relative to the interior face 34.

The present inventors also contemplate that the sealing strip may comprise additional anchor extensions at any desirable angle to receive and/or engage the insulation material layer and/or to receive and engage one or more slabs of curable building material to further strengthen and enhance the integration of the sealing strip 26 into the insulated panel 10.

Figure 3B:
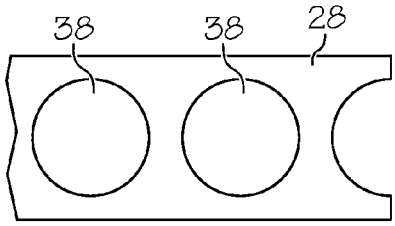
FIG. 3B is a side view of a sealing strip in accordance with yet another embodiment.

Referring to FIG. 3B, in another embodiment, the first anchor extension 28 and second anchor extension 30 each comprise a plurality of apertures 38. The plurality of anchoring apertures 38 strengthen the embedding of the first and second anchor extensions 28, 30 in the curable building material, and further secure the integration of the sealing strip 26. The anchoring apertures 38 allow the curable building material to pass through, thereby anchoring the sealing strip 26 to the curable building material. The anchor extensions 28, 30 may also each comprise a plurality of depressions. The plurality of anchoring apertures may comprise substantially round holes having a diameter ranging from approximately 0.5 cm to approximately 3 cm, or from approximately 0.7 cm to approximately 2.5 cm, or from approximately 1 cm to approximately 2 cm. Alternatively, the anchoring apertures may be rectangular or other shapes that may allow the curable building material to pass through.

In one embodiment, the sealing strip 26 comprises a moisture-proof material. The sealing strip 26 may be manufactured from a range of materials, such as polymers, metals, plastics, ceramics, and other extrudable moisture-resilient or moisture-impermeable materials. For example, the sealing strip 26 may comprise extruded polyvinyl chloride. The sealing strip 26 may be moisture impermeable or moisture resistant, thereby bestowing a moisture barrier to the insulated panel 10. In addition, such a configuration may provide the sealing strip 26 with relative flexibility and/or a structural integrity resilient to cracking, flaking, and/or chipping, yet permit cutting of the sealing strip as desirable to conform with dimensions of the mold and/or desired panel dimensions.

The sealing strip 26 may comprise an extruded monolithic structure. Alternatively, the sealing strip 26 may also be formed utilizing molding, and other techniques that will be appreciated by one of ordinary skill. The sealing strip 26 may also comprise individual parts, joined together through known means. For example, the first and second anchor extensions 28, 30 may be provided as distinct components from the panel cap 32 of the sealing strip 26. The individual components may be joined together in a manner sufficient to provide a moisture impermeable barrier. Also, it is contemplated that multiple sealing strips may be connected, end-to-end or otherwise, with taping, gluing, melding, or otherwise along a mold side 24 to form substantially moisture impermeable barrier, as will be appreciated by one of ordinary skill.

The sealing strip 26 is attached to the interior mold surface 22 using a removable adhesive 40. The sealing strip 26 is attached to at least one mold side 24 of the mold surface 22. The sealing strip 26 is positioned on the mold side 24 in a location to which allows both the first anchor extension 28 and the second anchor extension 30 to be sufficiently anchored in a first slab 44 and a second slab 48 respectively. In one configuration, the sealing strip 26 may be positioned in the center of the plurality of mold sides 24. Alternatively, the sealing strip 26 may be positioned towards the upper or lower extreme of the plurality of mold sides 24. For example, the center of the sealing strip 26 may be positioned 1 cm, 2 cm, 3 cm, 4 cm, or 5 cm from the center of the mold side. It is also contemplated the sealing strip 26 may be positioned at other distances from center to suit the particular insulation and panel design necessary for the particular application. Furthermore, the sealing strip 26 may be centered on the mold side 24.

In one configuration, the sealing strip 26 may be attached to less than all of the mold sides 24 of the interior mold surface 22. For example, no sealing strip may be provided on the mold side 24 that will ultimately comprise the bottom face of the insulated wall panel 10. The bottom face may be the side of the insulated panel 10 substantially parallel or adjacent to the ground. Without being bound by theory, leaving a single intermediate face 16 unsealed may allow any moisture that has entered the insulated panel 10 may be drained and removed through the unsealed bottom.

In one configuration, the removable adhesive 40 may comprise double-sided tape. Alternatively, the removable adhesive 40 may comprise glue, adhesive compound, or other device that removably retains the sealing strip 26 to the interior mold surface 22. Materials and/or devices used to attach the sealing strip 26 to the interior mold surface 22 generally permit easy release of the exterior face 36. For example, the removable adhesive 40 temporarily secures the sealing strip 26 to the mold bulkhead 18 and to permit the easy, non-destructive release thereof.

The method comprises introducing a curable building material into the interior mold volume 20 to form a first slab 44 defining the first major face 12. The first slab 44 may at least partially surround the first anchor extension 28. The amount of curable building material that may be introduced may be proportional to the size of the interior mold volume 20, and the location of the sealing strip 26 on the interior mold surface 22. The first slab 44 completely surrounds the first anchor extension 28 such that the entire first anchor extension 28 is contacted by curable building material. Alternatively, the curable building material may contact only a portion of each opposing surface of the first anchor extension 28. If the first anchor extension 28 comprises a plurality of anchoring apertures 38, the first slab 44 completely envelops the portion of the first anchor extension with the plurality of anchoring apertures 38 to form a seal.

The method also comprises inserting an insulation material layer 46 into the interior mold volume 20 within the sealed insulation zone 42 adjacent to the first slab 44 of curable building material. In one configuration, the mold bulkhead 18 may be provided in a horizontal orientation, such that a first slab 44 is poured and an insulation material layer 46 is inserted adjacent to the first slab 44. The insulation material layer 46 is provided within the sealed insulation zone 42 to prevent moisture from contacting the insulation material layer 46. The insulation material layer 46 may abut the first anchor extension 28, or may be oriented perpendicularly from the interior face 34 of the panel cap 32. The insulation material layer may abut the interior face of the sealing strip 26, or may be provided at a distance from the sealing strip, but still within the sealed insulation zone 42.

The dimensions of the insulation material layer 46 may vary throughout the longitudinal dimension of the insulated panel 10, such that in the sealed insulation zone 42, it is no wider than the sealed insulation zone 42, and towards the center of the insulated panel 10, the thickness of the insulation material layer 46 may be much thicker, or thinner, depending on the needs of the particular application. Alternatively, the thickness of the insulation material layer 46 may be uniform throughout the insulated panel 10.

The insulation material layer may be provided as a single unit, or a plurality of insulation units. The insulation units may be provided as individual components, and joined using the reinforcing molding skeleton as will be described below. The insulation material layer may also comprise gaps, channels, and other shapes that will allow reinforcing molding skeleton to interact with the insulation material layer, and provide the necessary integrity to the insulated panel. For example, the insulation material layer may have holes or channels that allow rebar and other structural material to pass through the insulation material layer, and join with the reinforcing skeleton provided in the first and second slabs. Furthermore, if a plurality of insulation units are utilized to provide an insulation material layer, they may be shaped and configured to interact with one another to fit within the confines defined the first and second slabs.

The thickness of the insulation material layer 46 depends on the level of insulation necessary for the particular application. If a higher R-value is desired, a thicker dimension of insulation material layer 46 may be provided in the insulated panel 10. The insulation material layer 46 may comprise a preformed sheet, a sprayable material, a rollable fibrous material, or other insulation material layer as will be appreciated by one of ordinary skill in the art. The insulation material layer 46 be made of a variety of materials, such as polystyrene, fiberglass, and other insulating materials as will be appreciated by one of ordinary skill.

The method may also comprise introducing a curable building material into the interior mold volume 20 adjacent to the insulation material layer 46 to form a second slab 48 defining the second major face 14. The second slab 48 at least partially surrounds the second anchor extension 30, such that only a portion of the second anchor extension 30 contacts the curable building material. The second slab 48 may completely surround the second anchor extension 30, such that the curable building material contacts both sides of the second anchor extension 30. If the second anchor extension 30 comprises a plurality of anchoring apertures 38, the second slab 48 completely envelops the portion of the second anchor extension 30 with the plurality of anchoring apertures 38 to form a seal one side of the sealed insulation zone 42 as described above with reference to the sealed insulation zone. The amount of curable material introduced may be proportional to the size of the interior mold volume 20, the amount of insulation material layer 46, and the size of the first slab 44.

The method also comprises introducing a curable building material into the interior mold volume 20 to form a first slab 44 defining the first major face 12. The first slab 44 at least partially surrounds the first anchor extension 28. The amount of curable building material introduced may be proportional to the size of the interior mold volume 20, and the location of the sealing strip 26 on the interior mold surface 22. The first slab 44 may completely surround the first anchor extension 28, such that the curable building material contacts both sides of the first anchor extension 28. If the first anchor extension 28 comprises a plurality of anchoring apertures 38, the first slab 44 completely envelops the portion of the first anchor extension with the plurality of anchoring apertures 38 to form a seal.

The curable building material may comprises concrete. Alternatively, the curable building material may comprise other hardening materials and concrete mixtures, as will be appreciated by one of ordinary skill.

Referring to FIG. 4, in one embodiment, the sealing strip 26 defines a sealed insulation zone 42. The sealed insulation zone 42 may comprise a volume of the insulated panel 10 that is protected from moisture seepage. The sealed insulation zone 42 extends inwardly towards the center of the insulation panel 10 from the interior face 34 of the panel cap 32. The lateral bounds of the sealed insulation zone 42 are defined by the first anchor extension 28 and the second anchor extension 30. The internal bound of the sealed insulation zone 42 is also defined by sealing line 43 extending from the distal edge of the first anchor extension 28 to the distal edge of the second anchor extension 30. The sealed insulation zone 42 may extend along the entire length of the sealing strip 26, and may be provided on all intermediate faces of the insulated panel. The first anchor extension 28 may be partially surrounded by a curable building material such that a seal is established by the interaction of the building material with the first anchor extension 28 and first slab 44, which provides a seal on one side of the sealed insulation zone 42. Similarly, the second anchor extension 30 is partially surrounded by a curable building material to form a seal on the opposing side of the sealed insulation zone 42 through the interaction between the second anchor extension 30 and the second slab 48.

The method also comprises allowing the curable material to cure to provide a cured insulated panel 10, wherein the panel cap 32 defines at least a portion of the plurality of intermediate faces 16. The curable material may be cured in a manner appropriate to provide the desired hardness suited to the particular curing conditions.

The method may also comprise separating the insulated panel 10 from the mold bulkhead 18 to allow the sealing strip 26 to remain integrated within the insulated panel. Depending on the method of removably attaching the sealing strip 26, the method may also comprise disengaging the sealing strip 26 from the mold bulkhead 18 before separating the insulated panel 10 from the mold bulkhead 18. Alternatively, the sealing strip 26 may be disengaged during the course of separating the insulated panel 10 from the mold bulkhead 18 in a single step.

The insulated panel device comprises a reinforcing molding skeleton. The reinforcing molding skeleton comprises a network of mesh, interacting junctions, and other molding structure. The reinforcing molding skeleton may be provided through the first slab, second slab, and insulation layer in a manner sufficient to form a single, integrated insulation panel. The reinforcing molding skeleton may connect the first slab 44, second slab 48, and insulation material layer together. The reinforcing molding skeleton extends from the first slab through the insulation material layer, and to the second slab in a manner sufficient to hold the insulated panel together as one integrated structure, such that the sealing strip is not the only device holding the insulated panel together. The reinforcing molding skeleton may be formed of rebar, or other similar material, as will be appreciated by one of ordinary skill.

It is also noted that recitations herein of "at least one" component, element, etc., should not be used to create an inference that the alternative use of the articles "a" or "an" should be limited to a single component, element, etc.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Rather, the claims appended hereto should be taken as the sole representation of the breadth of the present disclosure and the corresponding scope of the various inventions described herein. Further, it will be apparent that modifications and variations are possible without departing from the scope of the invention defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method of forming an insulated panel comprising a first major face, a second major faces, and a plurality of intermediate faces, the method comprising:

providing a mold bulkhead comprising an interior mold surface defining an interior mold volume, wherein the interior mold surface comprises a plurality of mold sides;

providing at least one sealing strip comprising a first anchor extension, a second anchor extension, and a panel cap, wherein the panel cap comprises an interior face and an exterior face;

removably attaching the exterior face of the sealing strip to the interior mold surface on at least one of the plurality of mold sides, wherein the first anchor extension and the second anchor extension project into the interior mold volume, and wherein the sealing strip defines a sealed insulation zone;

introducing a curable building material into the interior mold volume to form a first slab, wherein the first slab defines the first major face, wherein the first slab at least partially surrounds the first anchor extension;

inserting an insulation material layer into the interior mold volume, wherein the insulation material layer is at least partially within the sealed insulation zone;

introducing a curable building material into the interior mold volume adjacent to the insulation material layer to form a second slab, wherein the second slab defines the second major face, wherein the second slab at least partially surrounds the second anchor extension; and allowing the curable building material to cure to provide a cured insulated panel, wherein the panel cap defines at least a portion of at least one of the plurality of intermediate faces.

2. The method of claim 1, wherein the first anchor extension and the second anchor extension each comprise a plurality of anchoring apertures.

3. The method of claim 2, wherein the plurality of anchoring apertures comprise round holes having a diameter ranging from approximately 0.5 cm to approximately 3 cm.

4. The method of claim 2, wherein the plurality of anchoring apertures are encompassed by the curable building material.

5. The method of claim 1, wherein the at least one sealing strip is removably attached to at least three mold sides.

6. The method of claim 1, wherein a distal edge of the first anchor extension is provided at a distance greater than approximately 3 cm from the first major face, and wherein a distal edge of the second anchor extension is provided at a distance greater than approximately 3 cm from the second major face.

7. The method of claim 1, wherein the first anchor extension and the second anchor extension each respectively extend at an angle ranging from approximately 45° to approximately 135° relative to the interior face.

8. The method of claim 1, wherein the first anchor extension and the second anchor extension each respectively extend along an anchoring vector selected to ensure that respective distal edges of the first and second anchor extensions are displaced from the major and intermediate faces of the insulated panel by at least approximately 3 cm.

9. The method of claim 1, wherein the sealing strip comprises a polymer.

10. The method of claim 1, wherein the insulation material layer comprises polystyrene.

11. The method of claim 1, wherein the sealing strip is attached to the interior mold surface using a removable adhesive.

12. The method of claim 1, wherein the sealing strip comprises an extruded monolithic structure.

13. The method of claim 1, wherein the mold bulkhead is substantially rectangular.

14. The method of claim 1, further comprising separating the insulated panel from the mold bulkhead to allow the sealing strip to remain integrated within the insulated panel.

15. A method of forming an insulated panel comprising a first major face, a second major face, and a plurality of intermediate faces, the method comprising:

providing a mold bulkhead comprising an interior mold surface defining an interior mold volume, wherein the interior mold surface comprises a plurality of mold sides;

providing at least one sealing strip comprising a first anchor extension, a second anchor extension, and a panel cap, wherein the panel cap comprises an interior face and an exterior face;

removably attaching the exterior face of the sealing strip to the interior mold surface on at least one of the plurality of mold sides, wherein the first anchor extension and the second anchor extension project into the interior mold volume, and wherein the sealing strip defines a sealed insulation zone, wherein the first anchor extension and second anchor extension comprise a plurality of anchoring apertures, and wherein the first anchor extension and the second anchor extension respectively extend at an angle ranging from approximately 100° to approximately 135° relative to the interior face;

introducing a curable building material into the interior mold volume to form a first slab, wherein the first slab defines the first major face, wherein the first slab at least partially surrounds the first anchor extension;

inserting an insulation material layer into the interior mold volume, wherein the insulation material layer is at least partially within the sealed insulation zone;

introducing a curable building material into the interior mold volume adjacent to the insulation material layer to form a second slab, wherein the second slab defines the second major face, wherein the second slab at least partially surrounds the second anchor extension; and allowing the curable building material to cure to provide a cured insulated panel, wherein the panel cap defines at least a portion of at least one of the plurality of intermediate faces.

* * * * *